US005377589A

United States Patent [19]

Krüger et al.

[11] Patent Number: 5,377,589

[45] Date of Patent: Jan. 3, 1995

[54] DRIVE FOR A PRINTING PRESS

[75] Inventors: Michael Krüger, Edingen-Neckarhausen; Wolfgang Pfizenmaier, Neckargemünd; Georg Rössler, Angelbachtal; Bernhard Wagensommer, Wiesloch, all of Germany

[73] Assignee: Heidelberger Druckmaschinen AG, Heidelberg, Germany

[21] Appl. No.: 165,983

[22] Filed: Dec. 13, 1993

[30] Foreign Application Priority Data

Dec. 11, 1992 [DE] Germany ..... 4241807

[51] Int. Cl.[6] ..... B41F 13/34

[52] U.S. Cl. ..... 101/248; 101/216; 101/187; 226/28

[58] Field of Search ..... 101/248, 180, 181, 216, 101/219, 220, 224, 225, 226, 228; 226/42, 28, 2, 27, 29, 30–31; 318/77, 66, 67, 68, 69, 70

[56] References Cited

U.S. PATENT DOCUMENTS

| | | | |
|---|---|---|---|
| 3,765,328 | 10/1973 | Treff et al. . | |
| 4,183,296 | 1/1980 | Rambausek . | |
| 4,318,176 | 3/1982 | Stratton et al. | 101/248 |
| 4,512,256 | 4/1985 | Schriber et al. | 101/248 |
| 4,527,788 | 7/1985 | Masuda | 101/248 |
| 4,541,335 | 9/1985 | Tokuno et al. | 101/181 |
| 4,553,478 | 11/1985 | Greiner et al. | 101/181 |
| 4,719,575 | 1/1988 | Gnuechtel | 226/28 |
| 4,785,734 | 11/1988 | Kawana et al. | 101/219 |
| 4,852,785 | 8/1989 | Bettendorf et al. | 226/42 |
| 4,951,567 | 8/1990 | Rodi et al. . | |
| 5,036,764 | 8/1991 | Rodi | 101/181 |
| 5,117,753 | 6/1992 | Mamberer | 101/228 |
| 5,127,324 | 7/1992 | Palmatier et al. | 101/248 |

FOREIGN PATENT DOCUMENTS

| | | |
|---|---|---|
| 0096564 | 12/1985 | European Pat. Off. . |
| 2235765 | 2/1973 | Germany . |
| 2341510 | 4/1974 | Germany . |
| 105761 | 5/1974 | Germany . |
| 2334177 | 1/1975 | Germany . |
| 2948412 | 7/1980 | Germany . |
| 3318250 | 11/1984 | Germany . |
| 245166 | 4/1987 | Germany . |
| 3638441 | 10/1987 | Germany . |
| 3614979 | 11/1987 | Germany . |
| 3729911 | 3/1989 | Germany . |
| 3906646 | 9/1989 | Germany . |
| 1435837 | 5/1976 | United Kingdom . |
| 2038717 | 7/1980 | United Kingdom . |
| 2149149 | 6/1985 | United Kingdom . |
| 2184691 | 7/1987 | United Kingdom . |

OTHER PUBLICATIONS

German Periodical "Der Elektroniker" No. 4, 1983 (Joachim).

German Periodical Barmag Electronic (Special Public.) (Martens), 4 pgs. "Damit Gleichstrommotoren Synchron Laufen".

Sunderdruck ASR Magazin; American Barmag Corp. 1101 Westin Ghouse Blvd, Charlette, N.C. 28217, P.O. Box 7046 (No Date).

German Periodical Barmag Electronic, 2 pages (No Date) "Kompakt—Stromrichter" (Compact static converter).

German Periodical FOGRA No. 3.268 (Traber et al) 1992 p. 5, "Die Wärmebilanz der Farbwerke von . . . ".

*Primary Examiner*—Eugene H. Eickholt

*Attorney, Agent, or Firm*—Herbert L. Lerner; Laurence A. Greenberg

[57] ABSTRACT

Drive for a printing press having a plurality of printing units having plate cylinders, elements for transporting stock, and elements which do not transport stock includes a gear-transmission device for interconnecting the printing units, a plurality of motors, respectively, coupled at various locations to the gear-transmission device, a device for controlling and regulating delivered power connected to the motors, and a device for feeding signals regarding rotational speed in the gear-transmission device to the control and regulating device, the gear-transmission device including a gear-transmission unit for driving all of the stock-transporting cylinders and the plate cylinders; at least one of the motors being connected to the gear-transmission unit; at least one sensor for detecting motion variables in the gear-transmission unit; at least one drive for driving the elements of the printing press which do not transport stock; at least another sensor for detecting motion variables in the drive for driving the elements which do not transport stock; all of the sensors being connected to the control and regulating device.

3 Claims, 3 Drawing Sheets

DRIVE FOR A PRINTING PRESS

The invention relates to a drive for a printing press including machine sub-units employing a plurality of motors disposed in advance of or after the printing press.

To prevent printing errors, it has become known heretofore to supply the power required for driving a printing press at a plurality of locations of a closed gear train of a gear-transmission unit encompassing all of the sub-units. The power delivery from the electric or hydraulic motors used therefor is controlled so that a defined tooth-flank contact in one direction is always ensured, that the stressing or distortion of the gearwheels upon the occurrence of power peaks is not impermissibly high and that no mechanical vibrations are caused by the drive. In regard to the foregoing, reference can be had to published German Patent Documents DE 22 35 765, DE 29 48 412 A1, DE 23 34 177 C3, DD 105 761 A1, DD 245 166 A1, and DE 36 38 441 A1.

Due to the closed gearwheel train in each of the driven sub-units, however, the sheet or web-conveying devices are disadvantageously driven together with all of the devices which do not transport sheets or webs. During a production run in sheet-fed printing presses, for example, the driving devices for the impression cylinders and the plate cylinders are mechanically interconnected with the driving devices for the inking units and the dampening units, so that the power delivered by the motors is distributed to all of the aforementioned driving devices. To print in precise register, a high degree of synchronism in the sheet or web-transporting driving devices is required. Control of the synchronism through the power supply from the motors is additionally adversely affected, however, by disturbance variables which are produced within the driving devices which do not transport sheets or webs.

Constructions have also been proposed wherein the individual printing units of a printing press, the feeder, the delivery and connected cutting and folding devices are mechanically decoupled from one another and driven by a respective motor. Such heretofore known constructions have been described in the published British Patent Document 21 49 149 A, the German Patent Documents DE 37 29 911 A1 and DE 33 18 250 A1, and the German Periodical: Der Elektroniker, No. 4, 1983, pp. 46–48.

In these drive concepts, synchronism is assured not by a closed gearwheel train, but exclusively by the matched control of the power from the motors. Due to the large moments of inertia result, such a control is slow; especially when a change takes place in the printing speed, such as during the running-up or running-down of the printing press, errors of synchronism occur, which have a negative effect upon the printing quality. The aforementioned disturbance variables from the driving devices which do not transport sheets or webs once again have an adverse effect on the synchronism of the printing units.

It is accordingly an object of the invention to provide a drive for a printing press wherein the drive train of all of the devices which do not transport sheets or webs has a reduced influence on synchronism.

With the foregoing and other objects in view, there is provided, in accordance with the invention, a drive for a printing press having a plurality of printing units having plate cylinders, elements for transporting stock, and elements which do not transport stock, comprising gear-transmission means for interconnecting the printing units, a plurality of motors, respectively, coupled at various locations to the gear-transmission means, a device for controlling and regulating delivered power connected to the motors, and means for feeding signals regarding rotational speed in the gear-transmission means to the control and regulating device, the gear-transmission means including a gear-transmission unit for driving all of the stock-transporting cylinders and the plate cylinders; at least one of the motors being connected to the gear-transmission unit; at least one sensor for detecting motion variables in the gear-transmission unit; at least one drive for driving the elements of the printing press which do not transport stock; at least another sensor for detecting motion variables in the drive for driving the elements which do not transport stock; all of the sensors being connected to the control and regulating device.

In accordance with another feature of the invention, the elements which do not transport stock are elements for driving at least one inking unit, and the drive includes at least another gear-transmission unit connected to the elements for driving the at least one inking unit.

In accordance with a concomitant feature of the invention, the elements for driving the at least one inking unit have an angular velocity controllable per revolution as a function of ink density in a transport direction of the sheets.

Thus, the drive train of the printing press is divided into at least two drive sub-trains, of which a first drive sub-train comprises a first gear-transmission unit, which exclusively drives all of the stock-transporting cylinders and the plate cylinder. All of elements which do not transport stock are driven by another gear-transmission unit or by a plurality of other gear-transmission units associated either individually or in groups with the elements. For example, the inking units may each be driven separately by a motor and a gear-transmission unit. Connected to a first gear-transmission unit are one or more motors having a power output which is controlled in a conventional manner. For rotational-speed measurement, the first gearwheel train is provided with a rotational-speed sensor. The mechanical separation or decoupling of the first gear-transmission unit from all of the other driven elements substantially reduces the disturbing influences of those driven elements on the first gear-transmission unit. Because the first gear-transmission unit exclusively drives the stock-transporting cylinders and the plate cylinder and does not have to transmit the entire power required by the printing presses, it can be provided with dimensions and strength which are more economical over those provided heretofore in the art. The synchronism of the printing units is ensured by the gearwheel train closed over all of the printing units and by the power control of the motors supplying the first gear-transmission unit.

The rotational speed of the first gear-transmission unit and the rotational speeds of all of the other transmission units decoupled from the first transmission unit are matched to one another. For this purpose, a respective rotational-speed sensor is provided in each of the other gear-transmission units and generates an output signal which is processed within a control and regulating device together with an output signal from the rotational-speed sensor in the first gearwheel train. The control and regulating device delivers the signals to power actuators of all of the motors.

The invention offers a possibility for the elements which do not transport sheets or webs to be operated with a rotational speed which differs from that of the first gear-transmission unit. For example, the rotational speed of an inking unit may differ by a specific amount from the rotational speed of a plate cylinder, so that the rotational-speed difference is an additional parameter for influencing the ink distribution on the plate cylinder, from which an improvement in the inking may result. Furthermore, inking units which are not being used can be switched off, so that no additional wear and no unnecessary losses due to "idling" of the inking unit occur.

Other features which are considered as characteristic for the invention are set forth in the appended claims.

Although the invention is illustrated and described herein as embodied in a drive for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
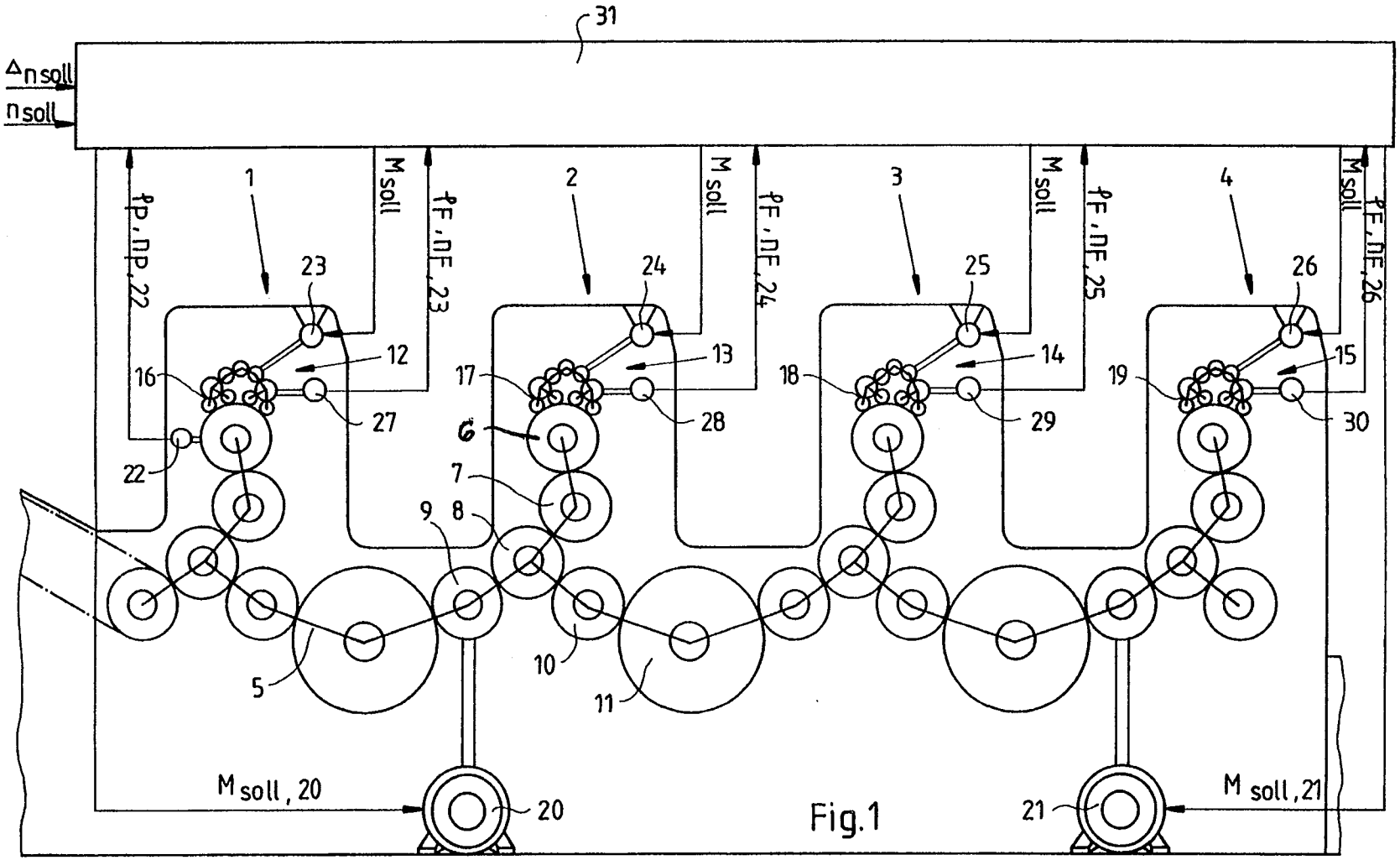
FIG. 1 is a schematic and diagrammatic fragmentary side elevational view of a printing press showing a drive with a plurality of drive trains constructed in accordance with the invention.

Referring now to the drawings and, first, particularly to FIG. 1 thereof, there are shown therein four printing units 1, 2, 3 and 4 of a sheet-fed printing press. For driving all of the sheet-transporting cylinders and the plate cylinder, they are interconnected in a gear-transmission unit 5, so that in the respective printing units 1, 2, 3 and 4, a plate cylinder 6, a rubber-blanket cylinder 7, an impression cylinder 8, a transfer drum 9, a storage drum 10 and a turning drum 11 rotate in synchronism. Respective inking units 12, 13, 14 and 15 assigned to each of the printing units 1, 2, 3 and 4 are each driven by a respective separate gear-transmission unit 16, 17, 18, 19 separate from the gear-transmission unit 5. Two main drive motors 20 and 21 feed into the gear-transmission unit 5. The rotational speed np and the rotational angle $\phi p$ of the gear-transmission unit 5 are measured by an incremental transmitter 22. The gear-transmission units 16, 17, 18 and 19 are each supplied by a respective inking-unit motor 23, 24, 25 and 26, and have a rotational speed $n_F$ and a rotational angle $\phi_F$, respectively, measured by a respective incremental sensor 27, 28, 29 and 30. Output signals of all of the incremental transmitters 22, 27, 28, 29 and 30 are supplied to a control and regulating device 31. Control outputs of the control and regulating device 31 are connected to the main drive motors 20 and 21 and the inking-unit motors 23, 24, 25 and 26 so as to produce a corresponding setpoint torque $M_{soll}$. The operating principle of the drive is described hereinafter with reference to FIG. 2:

In addition to the ink profile transverse to the transport direction of the sheets, the ink profile in the transport direction is determined by means of a plate reader and is stored as a function of the ink density $D_F$ dependent upon the rotational angle $\phi p$ of the control and regulating device 31 for each printing unit 1, 2, 3 and 4 in a memory 32.

In a further circuit arrangement 33, a setpoint differential rotational speed $\Delta n_{ref\,dyn}$ or dynamic slip between the inking rollers and the respective plate cylinder 6 is assigned to each ink-density value $D_F$. When this setpoint dynamic slip $\Delta n_{ref\,dyn}$ is added to a setpoint fixed static slip $n_{ref\,stat}$, there results therefrom a setpoint slip $\Delta n_{ref}$ to which the control and regulating device 31 regulates the rotational speeds $n_F$ and $n_p$.

The circuit arrangement 33 includes components which are specific to computer engineering, such as storage or memory components, for example. The circuit arrangement 33 is a realization of a characteristic element for the assignment, to a given or specific slip $\Delta_n$, of an ink-density value $D_F$ to be set. For each ink-density value $D_F$ dependent upon the rotational angle $\phi p$, a defined setpoint value of the dynamic slip $\Delta n_{ref\,dyn}$ results. In a simple case, the characteristic curve is a straight line.

Figure 2:
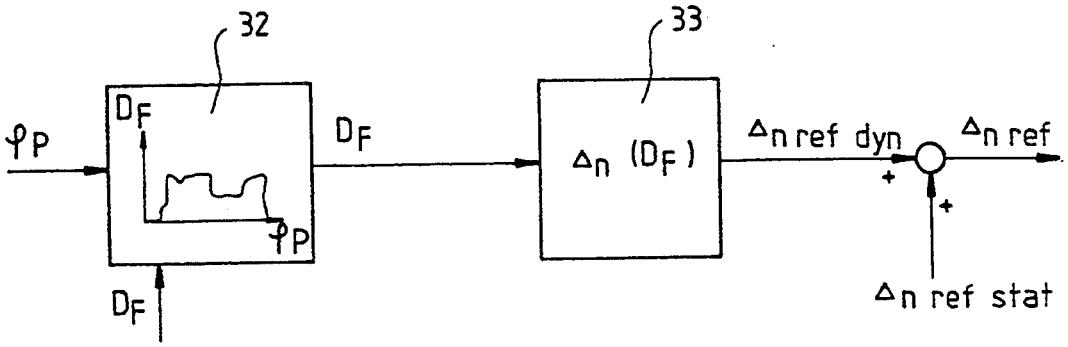
FIG. 2 is a schematic diagram of the motor control of an inking unit.
Figure 3:
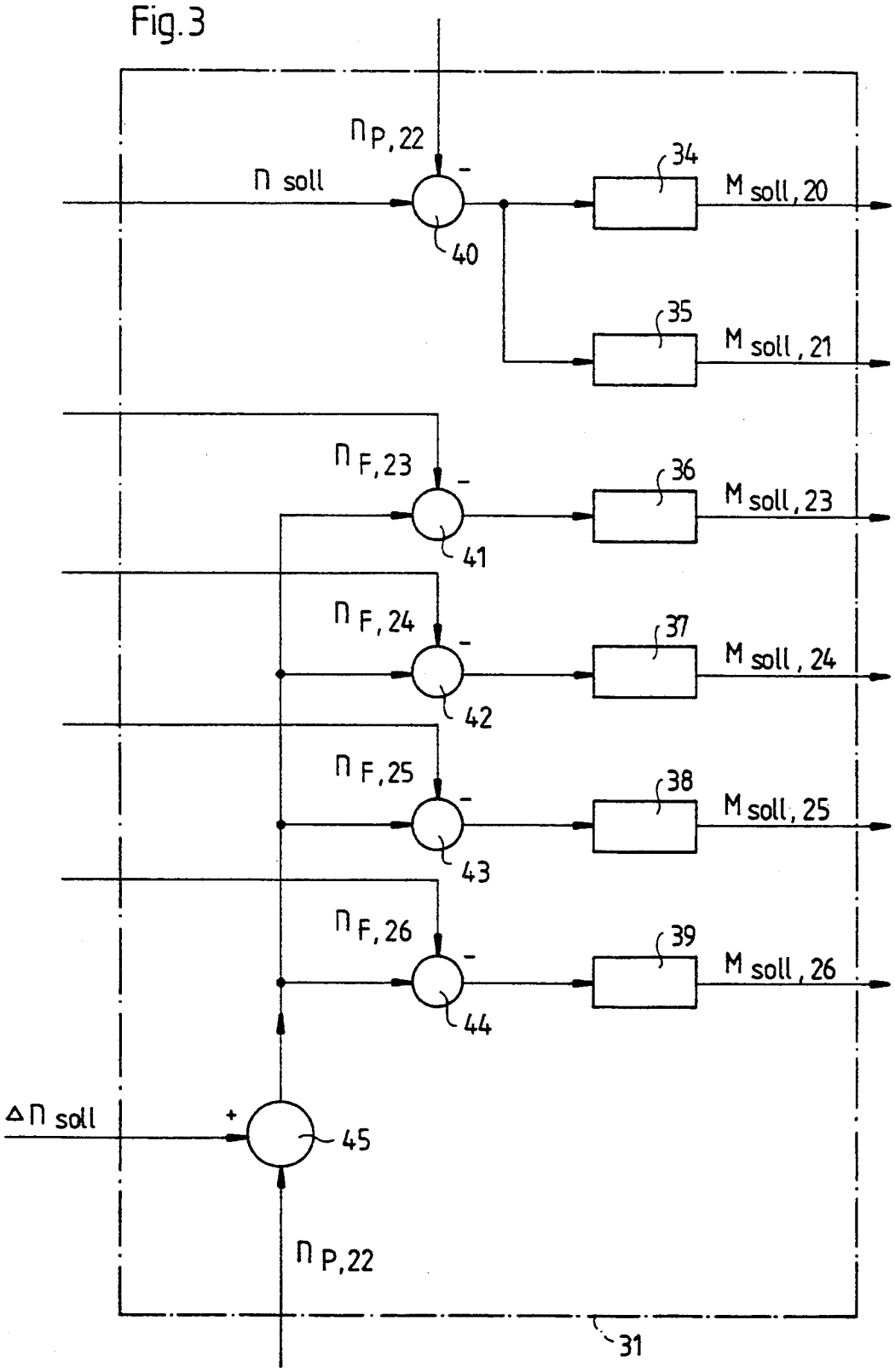
FIG. 3 is a schematic block diagram of a control and regulating device forming part of the invention.

FIG. 3 is a block circuit diagram of the control and regulating device 31 of FIG. 2. For each main drive motor 20 and 21 and for each inking-unit motor 23, 24, 25 and 26, separate rotational speed controls 34, 35, 36, 37, 38 and 39 are provided which have respective outputs from which setting or adjusting signals $M_{ref\,20}$ to $M_{ref\,26}$ are taken. The rotational speed controls 34, 35, 36, 37, 38 and 39, respectively, receive, as input signals thereto, differential signals from respective differential elements 40, 41, 42, 43 and 44. Signals $n_{p22}$ and $n_{F23}$ to $n_{F26}$, respectively, of the actual rotational speeds, which are produced by the incremental transmitters 22, 27, 28, 29 and 30, respectively, are applied to a differential input. At a second input to the differential element 40, a setpoint rotational speed value $n_{ref}$ for the main drive motors 20 and 21 is applied. Applied to a second input of the differential elements 41, 42, 43 and 44, respectively, are setpoint rotational speed values for the inking-unit motors 23, 24, 25 and 26, respectively, which are taken from an output of a summing element 45. The actual rotational speed value $n_{p22}$ of the gear transmission 5 is fed to an input of the summing element 45. The value $\Delta n_{ref}$ for the dynamic slip between the rotational speeds of the gear transmission 5 and the rotational speeds of the gear transmissions 16, 17, 18 and 19 is applied to a second input of the summing element 45.

With a decoupled inking-unit drive, this selective printed image-dependent variation within one revolution provides a possibility for controlling the ink-film thickness in the revolving direction. A similar drive concept is also possible for other separately driven elements, such as for separate dampening-unit drives, for example.

The power and rotational-speed control of the main drive motors 20 and 21 is effected in a conventional manner, so that a defined tooth-flank contact is always assured in the gear-transmission unit 5, and register errors caused by the drive during printing are minimized.

We claim:

1. Drive for a printing press having a plurality of printing units having plate cylinders, elements for transporting stock, and elements which do not transport stock, comprising gear-transmission means for interconnecting the printing units, a plurality of motors, respectively, coupled at various locations to said gear-transmission means, a device for controlling and regulating delivered power connected to said motors, and means for feeding signals regarding rotational speed in said gear-transmission means to the control and regulating device, said gear-transmission means including a gear-transmission unit for driving all of the stock-transporting cylinders and the plate cylinders; at least one of said motors being connected to said gear-transmission unit; at least one sensor for detecting motion variables in said gear-transmission unit; at least one drive for driving the elements of the printing press which do not transport stock; at least another sensor for detecting motion variables in said drive for driving the elements which do not transport stock; all of said sensors being connected to said control and regulating device.

2. Drive according to claim 1, wherein the elements which do not transport stock are elements for driving at least one inking unit, and including at least another gear-transmission unit connected to said elements for driving the at least one inking unit.

3. Drive according to claim 2, wherein said elements for driving the at least one inking unit have an angular velocity controllable per revolution as a function of ink density in a transport direction of the sheets.

* * * * *